United States Patent [19]

Kaufman

[11] 4,018,253

[45] Apr. 19, 1977

[54] HOME VACUUM APPARATUS FOR FREEZER BAGS

[76] Inventor: Seth Ian Kaufman, 5725 Leger, Cote St. Luc, Quebec, Canada

[22] Filed: Oct. 9, 1975

[21] Appl. No.: 621,067

[52] U.S. Cl. ..... 141/65; 141/314; 285/260

[51] Int. Cl.[2] ..... B65B 31/04

[58] Field of Search ..... 141/65, 66, 1, 8, 46, 141/114, 313–317, 311, 10, 67, 68, 7, 382–388, 392; 285/260

[56] References Cited

UNITED STATES PATENTS 2,695,741 11/1954 Haley ..... 141/65

*Primary Examiner*—Houston S. Bell, Jr.

[57] ABSTRACT

It is well known that food to be frozen, if placed in an evacuated container before it is frozen, will better retain the flavor and freshness of the food. However, there is no apparatus available and known to the applicant which permits evacuation of a container for food to be frozen in the home. The instant invention overcomes this deficiency by providing a system for evacuating flexible containers for food to be frozen in the home. The system includes a hollow retainer member adapted to receive the open end of the container, and a cap member which is adapted to fit over the outside surface of the retainer in airtight engagement therewith. A flexible tube extends downwardly through the bottom end of the cap member and upwardly above the cap member, and means are provided on the upward part of the tube for opening and closing the passage in the tube. In operation, the open end of the container is inserted through the hollow retainer and draped over the top end of the retainer, and the cap is mounted over the top surface of the retainer and the open end of the container and in airtight engagement therewith so that the tube passage is in airtight communication with the interior of the container. Air is withdrawn from the container through the tube, and the means on the upward part of the tube is then closed to close the tube passage.

7 Claims, 3 Drawing Figures

HOME VACUUM APPARATUS FOR FREEZER BAGS

BACKGROUND OF THE INVENTION

1. Field of the Invention

This invention relates to a system for evacuating a flexible container for food to be frozen. More specifically, this invention relates to such a system which is particularly adaptable for home use.

2. Description of the Prior Art

It is well known in the art that the flavour and freshness of food to be frozen is better preserved if the food is frozen in an evacuated container, i.e., the food is placed in a container which is evacuated before the food is frozen. A patent which relates to an apparatus for evacuating containers for such food is U.S. Pat. No. 2,956,886, Bausch, issued Oct. 18, 1960. As can be seen, the Bausch patent relates to an industrial type of apparatus which is not particularly adaptable for home use.

U.S. Pat. No. 76,917, Holden, issued Apr. 21, 1868 deals with an apparatus for evacuating a container in which food is to be preserved, and U.S. Pat. No. 3,851,437, Waldrop et al, issued Dec. 3, 1974, teaches an apparatus for evacuating a flexible food container such as a thermoplastic bag. The Holden apparatus, while simple enough for home use, would appear to have operating deficiencies, and the Walden et al apparatus is contemplated only for industrial use.

SUMMARY OF THE INVENTION

It is therefore an object of the present invention to provide a system with which to evacuate flexible containers whose operation is simple enough so that it can be used in the home.

It is a further object of the invention to provide such a system made of inexpensive parts so as to be affordable in the home and for home use.

In accordance with the invention, a system for evacuating a flexible container having an open end, comprise; a hollow retainer member adapted to receive said open end of said container; a cap member adapted to fit over the outside surface of said retainer member in airtight engagement therewith; a flexible tube extending downwardly through the bottom of said cap member and upwardly above said cap member; and means on the upward part of said tube for opening and closing the passage in said tube; whereby, the open end of said flexible container is adapted to be inserted through said hollow retainer member and to be draped over the top end thereof; and said cap member is adapted to be mounted over the top surface of said retainer member and said open end of said flexible container in airtight engagement therewith so that the passage of said tube is in airtight communication with the interior of said flexible container.

Said hollow retainer member, said cap member, said tube and said means on the upward part of said tube may comprise a material which can withstand freezing temperatures.

Preferably, said retainer member comprises a hollow cylindrical member with a flange encircling the bottom end thereof.

With the hollow cylindrical member, said cap member comprises a cylindrical cap and further comprises a tube holder means disposed at the top of said cap and concentric therewith.

Threads may be provided on the outside surface of said cylindrical member for mating engagement with grooves on the inside surface of said cylindrical cap.

An overhanging rim may extend from said flange.

The means on the upward part of said tube may comprise valve means.

BRIEF DESCRIPTION OF THE DRAWINGS

The invention will be better understood by an examination of the following description, together with the accompanying drawings in which.

DETAILED DESCRIPTION OF THE DRAWINGS

Figure 1:
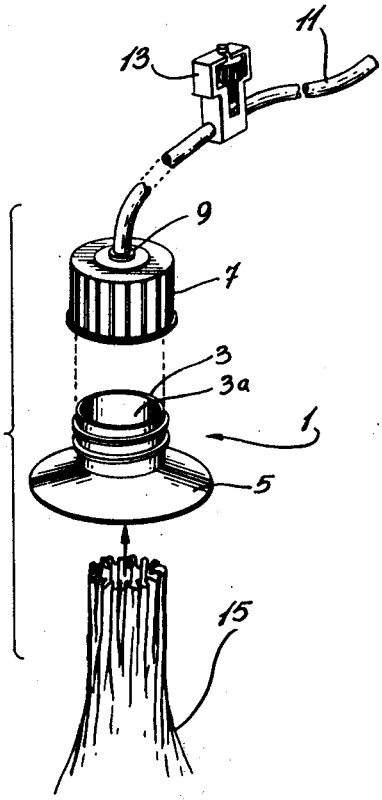
FIG. 1 is a perspective view of the cap and retaining means of the inventive system.

Referring now to the drawings, the inventive system comprises a retainer means, indicated generally at 1, and comprising a hollow cylindrical member 3 and a flange member 5 encircling the bottom end of the cylindrical member. The flange member may include an overhanging rim 6.

The system also comprises a cap member 7 which is adapted to fit over the outside surface of the cylindrical member 3 of the retainer means 1 in airtight engagement therewith. In the drawings, the cylindrical member is illustrated as including threads for engagement in mating grooves in the cap member to provide the airtight engagement. However, as will be clear to one skilled in the art, other arrangements could be used. Thus, the inside diameter of the cap member could be slightly smaller than the outside diameter of the cylindrical member, whereupon the cap would be force fitted over the cylindrical member to provide the airtight engagement. Alternatively, an adjustable collar could be mounted around the cap and tightened after the cap is placed on the cylindrical member to provide the airtight engagement. The important element is that the cap and retaining means be mated in airtight engagement.

Disposed at the top of the cap member 7, and concentric therewith, is a means 9 for holding a tube, and extending through the means 9, downwardly through the bottom of the cap member and upwardly above the cap member is a flexible tube 11.

On the upward part of the tube is a means 13 which is adaptable to open or close the tube passage. In the drawing, the means is shown as a valve having a screw 14 which presses a member, not shown, against the tube to close the tube passage when the screw 14 is turned in one direction, and which release the member to open the tube passage when the screw is turned the other way. Such means are well known in the art and require no further description here. Again, an adjustable collar could be mounted on the tube to encircle the tube, the collar to be tightened to close the tube passage and loosened to open the tube passage.

Figure 2:
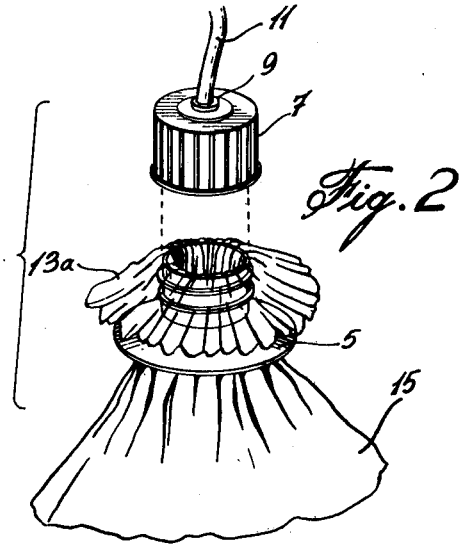
FIG. 2 illustrates how the flexible bag is inserted in the retaining means in operation.

In use, a bag 15, containing food to be frozen 17, is mounted on the retaining means 1 as shown in FIG. 2. The open end 15*a* of the bag is twisted till it is small enough to fit through the hollow cylindrical member 3. The bag is then inserted through the bottom end of the cylindrical member 3 and up through the top end and past the top end. The open end of the bag is then untwisted and draped over the cylindrical member as shown in FIG. 2.

Figure 3:
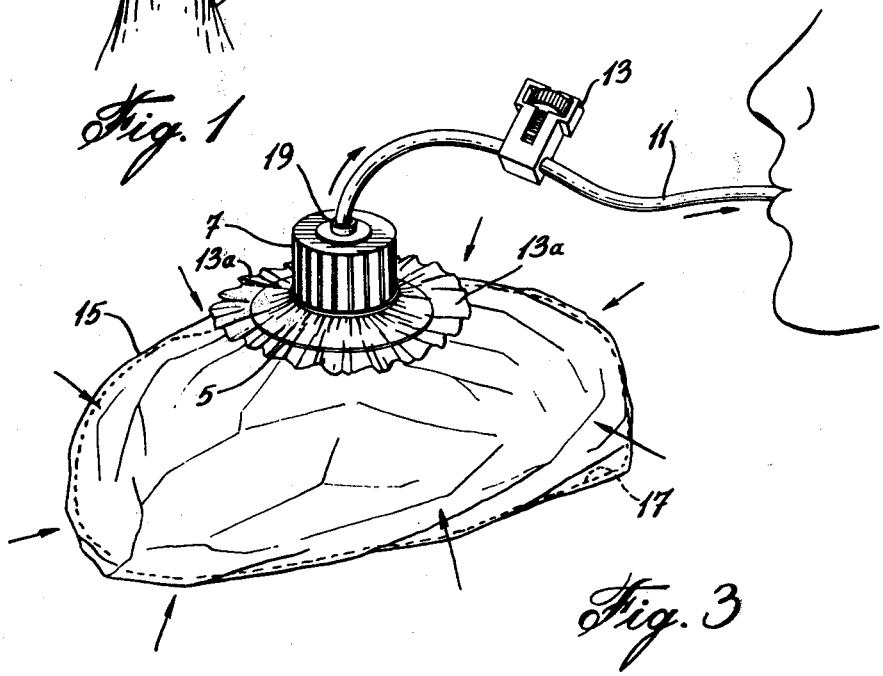
FIG. 3 is a perspective view of the system assembled.

With the bag so arranged, the cap member is mounted over the cylindrical member and the open end of the bag, in airtight engagement therewith, as shown in FIG. 3. In the illustrated embodiment, the cap member is screwed onto the cylindrical member until it is tight. The means 13 is then adjusted so that the tube passage is open.

As can be seen, the passage of the tube will now be in airtight communication with the interior of the bag 15. Air is then drawn out of the bag by suction means not shown. In the simplest mode of operation, the top end of the tube is held in the mouth of a person, as shown in FIG. 3, who then sucks the air out of the bag. Evacuation of the bag is clearly indicated by the collapse of the bag, and substantially complete evacuation occurs when the bag clings to the food 17 inside the bag.

It is also contemplated to provide a small hand pump or a syringe for the purpose of providing the suction force for evacuating the bag.

When the bag has been evacuated, the means 13 is adjusted to close the tube passage. The food, encased in the evacuated container, is now placed in a freezer compartment together with the evacuation system. As will be obvious, the parts of the system will have to be made of material which does not crack under the low temperatures in the freezer, and which will not deteriorate under these temperatures. Many plastic materials, well known in the art, have such properties.

The bags 15 can comprise plastic bags, particularly bags available in supermarkets for use in storing food in freezers.

It can be seen that the inventive system is simple of construction and can be made inexpensively. Further, the operation of the system is simple and well adapted for home use, and the system could replace other means being used such as Mason jars.

When the food is taken out of the freezer for consumption, the bag will, of course, be destroyed. But the remainder of the system, i.e., the retainer member, the cap member, the flexible tube and the valve means, are reusable.

Although a single embodiment has been described, this was for the purpose of illustrating, but not limiting, the invention. Various modifications, which will come readily to the mind of one skilled in the art, are within the scope of the invention as defined in the appended claims.

I claim:

1. A system for evacuating a flexible container having an open end, comprising;

a hollow retainer member adapted to receive said open end of said container;

a cap member adapted to fit over the outside surface of said retainer member in airtight engagement therewith;

a flexible tube adapted to extend downwardly through the bottom of said cap member into said container and upwardly above said cap member; and means on the upward part of said tube for opening and closing the passage in said tube;

whereby, the open end of said flexible container is adapted to be inserted through said hollow retainer member and to be draped over the top end thereof; and said cap member is adapted to be mounted over the top surface of said retainer member and said open end of said flexible container in airtight engagement therewith so that the passage of said tube is in airtight communication with the interior of said flexible container.

2. A system as defined in claim 1 wherein said hollow retainer member, said cap member, said tube and said means on the upward part of said tube comprise a material which can withstand freezing temperatures.

3. A system as defined in claim 1 wherein said retainer member comprises a hollow cylindrical member with a flange encircling the bottom end thereof.

4. A system as defined in claim 3 wherein said cap member comprises a cylindrical cap and further comprising a tube holder means disposed at the top of said cap and concentric therewith.

5. A system as defined in claim 4 comprising threads on the outside surface of said cylindrical member for mating engagement with grooves on the inside surface of said cap.

6. A system as defined in claim 3 wherein said cylindrical member comprises an overhanging rim extending from said flange.

7. A system as defined in claim 1 wherein said means on the upward part of said tube comprises valve means.

* * * * *